US005540350A

United States Patent [19]

Lansky

[11] Patent Number: 5,540,350

[45] Date of Patent: Jul. 30, 1996

[54] SPLASH/SLOSH GUARD FOR DRINKING VESSELS

[75] Inventor: Daryl J. Lansky, Memphis, Tenn.

[73] Assignee: Mallory Industries Inc., Blenheim, Canada

[21] Appl. No.: 389,765

[22] Filed: Feb. 16, 1995

[51] Int. Cl.[6] ..... B65D 43/03; A47G 19/22

[52] U.S. Cl. ..... 220/380; 220/713; 222/547

[58] Field of Search ..... 220/703, 704, 220/711, 713, 719, 731, 734, 373, 374, 380; 222/564, 547

[56] References Cited

U.S. PATENT DOCUMENTS

| | | | |
|---|---|---|---|
| 1,739,627 | 12/1929 | Austin . | |
| 1,811,896 | 6/1931 | Ross . | |
| 2,362,354 | 11/1944 | Clovis | 220/719 |
| 2,600,479 | 6/1952 | Campomar | 65/13 |
| 2,762,532 | 9/1956 | Packwood, Jr. | 222/564 |
| 2,858,041 | 10/1958 | Robinson | 220/90.4 |
| 3,302,833 | 2/1967 | Leika | 222/564 |
| 3,360,161 | 12/1967 | Smith | 220/90.4 |
| 3,549,044 | 12/1970 | Lerner | 220/719 |
| 4,130,215 | 12/1978 | Corey et al. | 220/90.4 |
| 4,768,674 | 9/1988 | Prescott | 220/719 |

*Primary Examiner*—Gary E. Elkins

*Assistant Examiner*—Nathan Newhouse

*Attorney, Agent, or Firm*—Fish & Richardson, P.C.

[57] ABSTRACT

A guard for preventing splashing or sloshing of hot or cold liquids from a drinking container with which the guard is used. The guard includes a lower disk having an outer circular rim for engaging the inner face of the side wall of the drinking container, an upper disk having an outer rim spaced from the drinking container to provide an annular passage between the upper disk and the inner face of the side wall of the drinking container with which the guard is used, a baffle interposed between the lower disk and the upper disk for functioning to baffle the beverage when the drinking container is in motion and to act as a support for supporting the upper disk from the lower disk, and a passageway is provided through the lower disk to allow passage of the beverage through the lower disk to a position above the lower disk. An upstanding handle is provided on the upper disk and a receptacle is provided on the lower disk to removably receive the handle and permit stacking of the guards. A modified embodiment is disclosed which includes a sealing lip for sealing the edge of the guard with the edge of the drinking container. Another modified embodiment is disclosed in which a removable rim attached along perforations to the outer circular rim of the upper disk to seal the edge of the guard with the edge of the drinking container to transport liquids that are not ready to be consumed.

29 Claims, 2 Drawing Sheets

SPLASH/SLOSH GUARD FOR DRINKING VESSELS

BACKGROUND OF THE INVENTION

1. Field of the Invention

The present invention relates, in general, to a guard for preventing splashing or sloshing of hot or cold liquids from a drinking container such as a disposable plastic cup or other drinking container with which the guard is used.

2. Information Disclosure Statement

It is often desired to move from one place to another a container of hot or cold liquids, such, as for example, a STYROFOAM cup of hot coffee, without sloshing the contents thereof, particularly as occurs during any quick movement of the cup, as for example, when it is jostled and the liquid moves about in the cup from side to side.

It is therefore desirable to have a guard that can be used with an existing cup such as a disposable cup, of expanded synthetic resinous material, such as that sold under the trademark STYROFOAM or another type of plastic or ceramic drinking apparatus, without modifying the cup, and which guard substantially prevents the splashing or sloshing of the hot or cold liquid from the cup as the cup is moved. Also, it is desirable to have such a guard that provides a means for the drinking of beverages from a cup without splashing or sloshing the beverage from the cup.

A preliminary patentability search in Class 220, subclasses 369, 374, 719, 731,703, and 718, produced the following patents, some of which may be relevant to the present invention: Austin, U.S. Pat. No. 1,739,627, issued Dec. 17, 1929; Ross, U.S. Pat. No. 1,811,896, issued Jun. 30, 1931; Campomar, U.S. Pat. No. 2,600,479, issued Jun. 17, 1952; Robinson, U.S. Pat. No. 2,858,041, issued Oct. 28, 1958; Smith, U.S. Pat. No. 3,360,161, issued Dec. 26, 1967; and Corey et al. U.S. Pat. No. 4,130,215, issued Dec. 19, 1978.

SUMMARY OF THE INVENTION

The present invention is directed towards providing an improved guard for preventing splashing or sloshing of hot or cold liquids from a drinking container such as a cup of expanded synthetic resinous material, such as that sold under the trademark STYROFOAM, or the like typically found in a fast food restaurant.

It is an object of the present invention to provide a means of drinking from a disposable cup, hot or cold beverages, without splashing or sloshing the beverage from the cup, and while the drinker is in motion.

It is an object of the present invention to allow such beverages to be moved without splashing or sloshing the contents from the drinking vessel while it is in motion.

It is a further object of the present invention to provide a means of drinking from any location around the rim of the cup. With the use of the present invention there are no openings for alignment with the drinker's lips in order to drink. This quality allows for normal retreat of the beverage, thus further preventing splashing or sloshing while drinking in motion, unlike other devices of similar art that must find openings for fluid transfer.

A further object of the present invention is to allow one to pick up the cup as if it had no drinking device or guard. A drinker would not need to rotate the cup to a drinkable position.

A still further object of the invention is to allow normal drinking from the cup just as if there were no device used. There are no buttons to push or rotate in order to drink, and normal drinking flow is not inhibited by the device such as that encountered in devices that have openings or slots from which to drink. Also, while drinking with the guard engaged, one may use their personal mug and their lips will touch the rim as if there were no device.

A further object of the invention is to prevent sloshing to a higher degree than heretofore possible with the use of vertical baffles as well as a lower level disk or baffle having a continuous 360 degree outer rim means for engaging the inner side of the cup, and without compromising access to drinking from the cup.

A further object is to provide a device that is held in place by friction and without any modification of the cup being necessary, and which is easily removed in order to allow for the addition of more beverage or the like.

A further object of the invention is to allow for easy fit to various cup sizes because the device only engages the cup at either the fill line or at the rim of the cup. Thus, the fill line diameter or lid size is the only information necessary to order the guards to fit the particular size cups used, as opposed to prior a device which does not engage the cup along a single circular line but engages the inner face of the wall of the cup over more than one level, i.e., along a portion of the upwardly and outwardly sloping inner face of the wall of the cup. With such prior devices, in order for the devices to fit the sloping inner face of the wall of the cup, it is necessary to take into account the inner wall angle of the cup so that this additional information would be needed to order the device, and other problems could be encountered such as caused by irregularities or deformations in the wall of the cup. The fact that, with the present invention, only the lower baffle or disk of the device touches the inner face of the wall of the cup or with modifications the guard is attached to the cup at the rim as one would place a lid on a cup today.

A further object of the invention is to allow for the beverage container to be vented 360 degrees to allow for heat to escape at a logical location and other than at the location from which a person must drink. Thus, a person may experience a sense of smell as well as a taste with the guard of the present invention.

A further object is to provide a first modified embodiment of the present invention which includes sealing means integrally attached to the outer circular rim means of the lower disk of the guard for sealably engaging the wall of the drinking container.

A further object is to provide a second modified embodiment of the present invention which includes a removable rim that is easily separated along perforations or a scored line which is attached to the outer circular rim of the upper disk for sealably engaging the rim or upper edge of the drinking container when the guard is in a first condition for use with the drinking container to transport liquids that are not ready to be consumed, and said removable rim being detachable from the outer circular rim of the upper disk to provide a second condition of the guard in which the guard is used for preventing splashing or sloshing of a beverage from the drinking container with which the guard is used.

DESCRIPTION OF THE PREFERRED EMBODIMENTS

Figure 1:
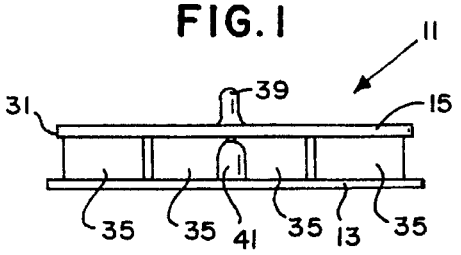
FIG. 1 is a side elevational view of the guard of the present invention.
Figure 2:
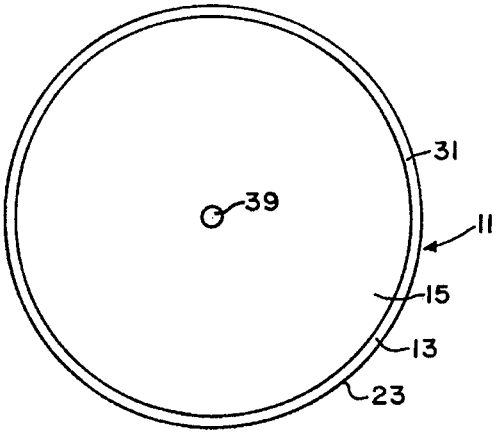
FIG. 2 is a top plan view of the guard shown in FIG. 1.
Figure 3:
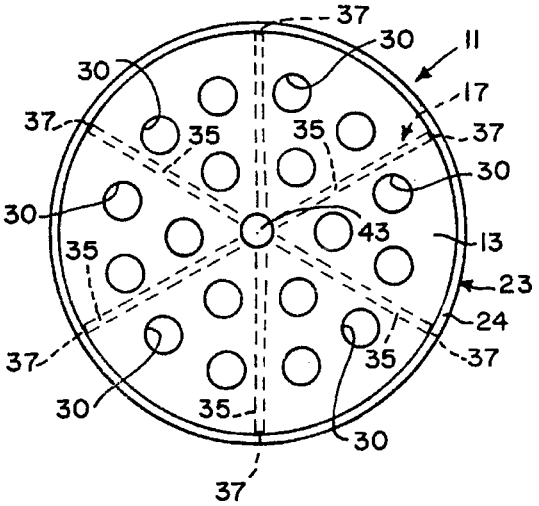
FIG. 3 is a bottom view of the guard shown in FIG. 1.

Referring now to FIGS. 1–3, the preferred embodiment of guard 11 of the present invention comprises, in general, a lower baffle or disk 13, an upper baffle or disk 15, and baffle means 17 interposed between lower disk 13 and upper disk 15. It will be understood that disks 13, 15 also act as baffles but for clarity will be hereinafter designated "disks".

Figure 4:
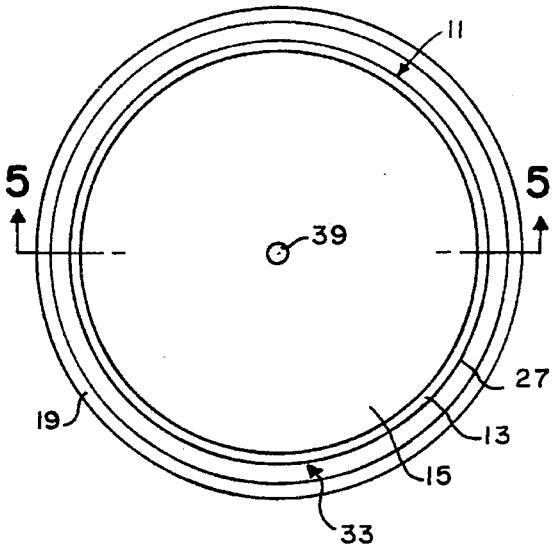
FIG. 4 is a top plan view of the guard of the present invention shown mounted in a plastic drinking cup.
Figure 5:
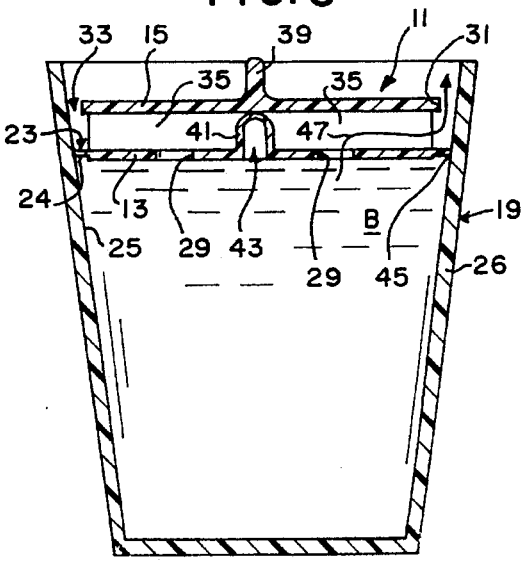
FIG. 5 is a sectional view taken as on the line 5—5 of FIG. 4.

Guard 11 is adapted to be used with a drinking container, such as a disposable plastic drinking cup 19 shown in FIGS. 4 and 5, for preventing splashing or sloshing of hot or cold liquids, such as liquid or beverage B from cup 19. When in place in cup 19, upper and lower disks 13, 15 are both horizontally disposed as shown in FIG. 5.

Lower disk 13 has a continuous and unbroken 360 degree outer circular rim or rim means 23 for engaging the inner side or inner face 25 of the frusto-conical side wall 26 of cup 19, as best seen in FIG. 5, with the engagement of outer rim 23 and the inner face 25 of cup 19 covering a continuous and entire 360 degree horizontally disposed circle, as at 27, around the inner face 25 of cup 19. Lower disk 13 has passageway means 29 for the beverage B to pass from beneath lower disk 13 to a position above lower disk 13 between lower disk 13 and upper disk 15. Outer rim 23 includes a gasket or flap 24 which extends around the entire rim 23. Flap 24 is preferably of the same material as the remainder of guard preferably, though not necessarily, thinner and more flexible in order to assist in seating and sealing the guard 11 into the cup 19 or other drinking container. Also, flap 24 provides for a means of fitting a larger number of drinking container sizes with one size guard 11. However, it should be pointed out that flap 24 may be omitted without departing from the spirit and scope of the present invention so that in the use of guard 11 with cup 19 the outer rim 23 without the flap 24 engages the cup in a manner described later in the specification. Passageway means 29 preferably includes one or more openings 30 through lower disk 13, as best seen in FIG. 3. The opening or openings 30 may be circular, rectangular, triangular, heart shaped, etc. The number and shape may vary. Openings 30 need only be spaced uniformly around lower disk 13 and have an equal amount of opening between the baffles 35 of baffle means 17 to assure uniform fluid transfer around the cup 19 with which used.

Upper disk 15 has a continuous and unbroken 360 degree outer circular rim or rim means 31, which is slightly smaller in diameter than outer rim 23 of lower disk 13, for being spaced from the inner face 25 of cup 19 with which guard 11 is used and with upper disk 15 being spaced vertically above lower disk 13 on the same vertical axis as lower disk 13 so that an annular passage 33 is provided 360 degrees around the entire outer circular rim 31 between the rim 31 and the inner face 25 of the cup wall 26.

Baffle means 17 preferably includes a plurality of solid and flat sheet-like baffles 35 extending radially outwardly from adjacent the center of guard 11 respectively to the outer ends 37 of the baffles 35 where they terminate adjacent to rim 31, as seen in FIG. 5. Baffles 35 extend vertically and spanningly between lower disk 13 and upper disk 15, and are fixedly attached at the lower and upper edges of baffles 35 respectively to lower and upper disks 13, 15. In the drawings there are shown six baffles 35 arranged around guard 11 at 60 degree intervals. However, the number and spacing of baffles 35 may be more or less than that shown. It is only necessary to have baffles 35 spaced uniformly around disks 13, 15. Also, in the drawing there are shown three openings 30 arranged in a triangular pattern between each adjacent pairs of baffles 35 as best seen in FIG. 3. However, the number and pattern of openings 30 may be different from that shown. It is only necessary to arrange the openings 30 uniformly around disks 13, 15 in a plurality of groups of equal open space being disposed between adjacent pairs of baffles 35.

A tab or handle 39 is preferably fixedly attached to upper disk 15 and extends upwardly from adjacent the center thereof. A receptacle 41 is fixedly attached to lower disk 13 and extends upwardly from adjacent the center thereof. Receptacle 41 is provided with a downwardly opening socket 43 extending through lower disk 13 and sized to loosely receive a handle 39. Thus, guards 11 may be stacked one upon another with the handles 39 of adjacent lower guards 11 respectively extending into sockets 43 of adjacent upper guards 11.

The different parts of guard 11, i.e., baffle means 17, upper disk 15, lower disk 13, handle 39, and receptacle 41 are preferably integrally formed together as a single entity from plastic or the like. Also, it should be pointed out that the thickness of the parts of guard 11, as well as the modifications thereof to be described later in the specification, may be varied without departing from the spirit and scope of the present invention.

In the use of guard 11, it is placed horizontally in a drinking container, such as the plastic cup 19. The size of guard 11 should be chosen to fit in the cup 19 so that rim 23 of the lower disk 13 frictionally fits against the inner face 25 of the side wall 26 of cup 19 at a place adjacent the normal filling level 45 of the beverage B in cup 19, as best seen in FIG. 5.

From the foregoing description, it will be understood that in drinking from a cup such as cup 19 with guard 11 used therewith, the user can drink from any location around the rim of the cup because, when the cup is tilted, the beverage B flows through the space between lower disk 13 and upper disk 15 and thence outwardly through the annular passage 33 at the lowest part of the rim of the tilted cup which is where the user's lips will be placed for drinking. The arrow at 47 indicates the flow of beverage B when the rim of cup 19 is tilted clockwise downwardly to the right as viewed in FIG. 5. The advantages of being able to drink from any position along the rim of the cup is realized when it is considered that, with the use of some of the other guards, it is necessary to position the cup at a certain place to drink, as for example, with a guard that has a opening at the rim that must be aligned with the drinker's lips in order to drink beverage from the cup. This advantage of the present invention over such previous guards is particularly apparent when a person who is drinking a beverage such as hot coffee is driving a vehicle and, at that person's risk and at the risk of the vehicle's passengers, must divert his or her attention from driving to align the opening with his or her lips in order to drink the coffee.

Also, it will be understood that the present invention provides an improved means for preventing splashing or sloshing of hot or cold liquids from a drinking container because of the continuous 360 degree outer rim 23 of lower disk 13. The inventor of the present invention has discovered that, in the use of a cup without the guard 11 of the present invention, it is the movement of the beverage against and upwardly along the inner face 25 of the wall 26 of the cup that causes the sloshing and splashing of the beverage. This same thing is true when other guards are used which are not continuous along the rim but which have slots or the like along the rim. However, with the use of the guard 11 of the present invention the continuous rim 23 stops the beverage from going up the side of the cup. Also, it should be pointed out that baffles 35 prevent further movement of the beverage.

Figure 6:
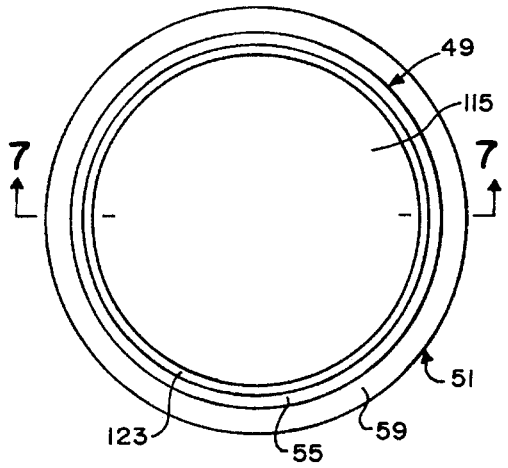
FIG. 6 is a top plan view of a first modified embodiment of the present invention shown mounted in a plastic drinking cup.
Figure 7:
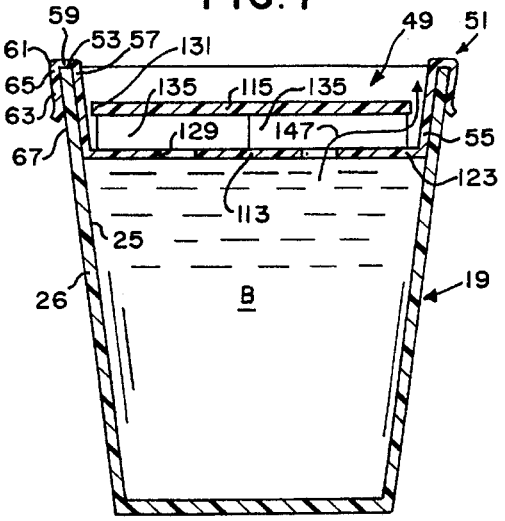
FIG. 7 is a sectional view of the first modified embodiment of the present invention taken as on the line 7—7 of FIG. 6.

Referring now to the alternate embodiment shown in FIGS. 6 & 7, the parts of the modified guard 49 which are similar to corresponding parts of guard 11 are designated by the same number as used for guard 11 preceded by the numeral 1. Thus, lower disk 113, upper disk 115, rim 123, rim 131, and baffles 135 of guard 49 correspond to and are similar in construction to lower disk 13, upper disk 15, rim 23, rim 31, and baffles 35 of guard 11. Primarily, the differences of guard 49 from guard 11 relate to the sealing lip or sealing means 51 which is integrally attached to outer circular rim means 123 of lower disk 113 around the entire circumference of lower disk 113 for sealably engaging the upper edge 53 of cup 19.

More specifically, sealing means 51 includes a frusto-conically shaped wall 55 for engaging the inner face 25 of the side wall 26 of cup 19. Also, sealing means 51 includes an annular portion 59 integrally attached to upper edge 57 of frusto-conically shaped wall 55 around the entire circumference of the wall 55 and extends radially outwardly therefrom, terminating in a circular outer edge 61. Additionally, sealing means 51 includes a depending portion 63 having an upper edge 65 integrally attached to outer edge 61 of annular portion 59 and depending therefrom around the entire circumference of the annular portion 59 for frictionally and snugly engaging the outer face 67 of wall 26 of cup 19 adjacent the upper edge 53 and around the circumference thereof.

Guard 49 preferably has no flap 24, no handle 39, no receptacle 41, and no socket 43, although any or all of these parts may be provided in guard 49, if desired. Guard 49 is used for preventing splashing and sloshing of beverage B in the same manner as heretofore described for guard 11. Also, the arrow at 147 indicates the flow of beverage B when the rim of the cup 19 is tilted clockwise downwardly to the right as viewed in FIG. 7.

Figure 8:
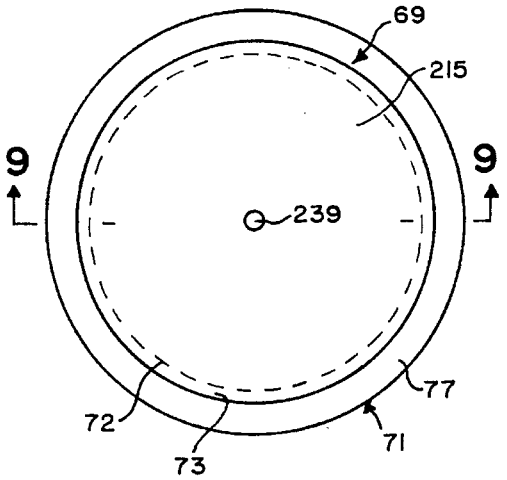
FIG. 8 is a top plan view of a second modified embodiment of the present invention shown mounted in a plastic drinking cup.
Figure 9:
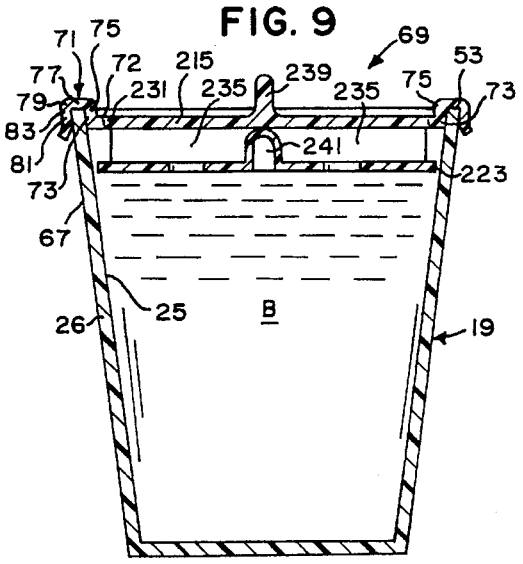
FIG. 9 is a sectional view of the second modified embodiment of the present invention taken as on the line 9—9 of FIG. 8.

Referring now to another alternate embodiment shown in FIGS. 8 & 9, the parts of the modified guard 69 which are similar to corresponding parts of guards 11 are designated by the same number as used for guard 11 preceded by the numeral 2. Thus, lower disk 213, upper disk 215, rim 223, rim 231, baffles 235, handle 239, and receptacle 241 of guard 69 correspond to and are similar in construction to lower disk 13, upper disk 15, rim 23, rim 31, baffles 35, handle 39, and receptacle 41 of guard 11. Primarily, the differences of guard 69 from guard 11 relate to the removable rim or removable rim means 71 that is easily separated along a scored line or perforations 72 which is attached to the outer circular rim means 231 of upper disk 215 around the periphery thereof for sealably engaging the rim or upper edge 53 of cup 19 when guard 69 is in a first condition for use with cup 19 and which removable rim means 71 is detachable from outer circular rim means 231 of upper disk 215 along scored line or perforations 72 to provide a second condition of guard 69 in which the guard is used for preventing splashing or sloshing of a beverage from cup 19.

More specifically, removable rim means 71 includes a frusto-conically shaped wall 73 for engaging the inner face 25 of the side wall 26 of cup 19. Also, removable rim means 71 includes a circular transverse portion 77 integrally attached to upper edge 75 of frusto-conically shaped wall 73 around the entire periphery of the wall 73 and extends radially outwardly therefrom, terminating in a circular outer edge 79. Additionally, removable rim means 71 includes a depending portion 81 having art upper edge 83 integrally attached to outer edge 79 of annular portion 77 and depending therefrom around the entire periphery of the annular portion 77 for frictionally and snugly engaging the outer face 67 of wall 26 of cup 19 adjacent the upper edge 53 and around the periphery thereof.

Once the removable rim means 71 is removed at the perforations 72, i.e. when guard 69 is in said second condition, the guard 69 becomes the same as the guard 11 and is used in the same manner heretofore described for guard 11. After the removable of rim means 71, the rim means is then discarded.

Advantages of guard 69 when the guard is in said first condition enables one to transport liquids in a spill proof container. One may not be ready to consume the beverage and in the case of hot liquids the heat of the beverage is retained to a higher degree than if the cup was left open.

Other advantages of the present invention and the modified embodiments thereof can be seen by referring to the objects heretofore listed.

Although the present invention has been described and illustrated with respect to a preferred embodiment and a preferred use therefor, it is not to be so limited since modifications and changes can be made therein which are within the full intended scope of the invention.

I claim:

1. A guard for preventing splashing or sloshing of a beverage from a drinking container having an inner and an outer wall said guard comprising:

(a) a lower disk having a continuous outer rim for engaging the inner wall of the container to prevent the beverage from flowing between the outer rim of the lower disk and the inner wall of the container, said lower disk having passageway means for the beverage to pass from beneath the lower disk to a position above the lower disk;

(b) an upper disk having a continuous outer rim, the diameter of said upper disk being smaller than the diameter of the inner wall of the container to allow the beverage to flow between the outer rim of the upper disk and the inner wall of the container at any point around the outer rim of the upper disk, said upper disk being disposed above and spaced apart from said lower disk; and (c) baffle means interposed between said lower disk and said upper disk for baffling the beverage when the container is in motion and for supporting said upper disk over said lower disk.

2. The guard of claim 1 in which said passageway means includes one or more openings through said lower disk.

3. The guard of claim 1 in which said baffle means includes a plurality of baffles extending radially outwardly from the center of said guard.

4. The guard of claim 1 in which the outer rim of said lower disk further comprises a flap for securely engaging the inner wall of the drinking container.

5. The guard of claim 2 in which said baffle means includes a plurality of baffles having equal spacing therebetween and respectively extending radially outwardly from the center of said guard.

6. The guard of claim 5 in which said passageway means includes a plurality of openings through said lower disk, said openings being arranged uniformly around said lower disk in a plurality of groups of equal open space being disposed between adjacent pairs of said baffles.

7. The guard of claim 6 which includes a handle attached to said upper disk and extending upwardly therefrom.

8. The guard of claim 7 in which said guard includes a receptacle opening downwardly from said lower disk and adapted to removably receive therein the handle of another guard when stacked therewith.

9. The guard of claim 1 which includes sealing means integrally attached to the outer rim of the lower disk for sealably engaging the upper edge of the drinking container.

10. The guard of claim 9 in which said sealing means comprises:

(a) a frusto-conically shaped wall for engaging the inner wall of the drinking container, said frusto-conically shaped wall having an upper edge;

(b) an annular portion integrally attached to said upper edge of said frusto-conically shaped wall, extending outwardly therefrom, and terminating in an outer edge; and (c) a depending portion having an upper edge integrally attached to the outer edge of said annular portion and depending therefrom for frictionally and snugly engaging the outer wall of the drinking container adjacent the upper edge of the container.

11. The guard of claim 1 which includes removable sealing means attached to the outer rim of the upper disk for sealably engaging the upper edge of the drinking container when the guard is in a first condition for use with the drinking container to transport liquids that are not ready to be consumed, and said removable rim means being detachable from the outer circular rim means of the upper disk to provide a second condition of the guard in which the guard is used for preventing splashing or sloshing of a beverage from the drinking container with which the guard is used.

12. The guard of claim 11 wherein said removable sealing means includes:

(a) a frusto-conically shaped wall for engaging the inner face of the wall of the drinking container, said frusto-conically shaped wall having an upper edge;

(b) an annular portion integrally attached to said upper edge of said frusto-conically shaped wall, extending outwardly therefrom, and terminating in an outer edge; and (c) a depending portion having an upper edge integrally attached to the outer edge of said circular transverse portion and depending therefrom for frictionally and snugly engaging the outer face of the wall of the drinking container adjacent the upper edge thereof.

13. In combination, a drinking container including a side wall having a frusto-conically shaped sloping inner face and a guard for preventing splashing or sloshing of a beverage from the drinking container, said guard comprising:

(a) a lower disk having a continuous outer rim for removably engaging the inner face of the drinking container to prevent the beverage from flowing between the outer rim of the lower disk and the inner face of the side wall of the container, said lower disk having passageway means for the beverage to pass from beneath the lower disk to a position above the lower disk;

(b) an upper disk having a continuous outer rim, the diameter of said upper disk being smaller than the inner face of the side wall of the drinking container to provide an annular passage for the beverage at any point around the outer rim of the upper disk, and for being spaced vertically above said lower disk; and (c) baffle means interposed between said lower disk and said upper disk for baffling the beverage when the drinking container is in motion and for supporting said upper disk over said lower disk.

14. The combination of claim 13 in which said passageway means includes one or more openings through said lower disk.

15. The combination of claim 14 in which said baffle means includes a plurality of baffles having equal spacing therebetween and respectively extending radially outwardly from the center of said guard.

16. The combination of claim 15 in which said passageway means includes a plurality of openings through said lower disk, said openings being arranged uniformly around said lower disk in a plurality of groups of equal open space being disposed between adjacent pairs of said baffles.

17. The combination of claim 16 which includes a handle attached to said upper disk and extending upwardly therefrom.

18. The combination of claim 17 in which said guard includes receptacle means opening downwardly from said lower disk and adapted to removably receive therein the handle of another guard when stacked therewith.

19. The combination of claim 13 in which said baffle means includes a plurality of baffles extending outwardly from the center of said guard.

20. The combination of claim 13 which includes sealing means integrally attached to the outer rim of the lower disk for sealably engaging the upper edge of the drinking container.

21. A guard for preventing splashing or sloshing of a beverage from a drinking container having an inner wall, said guard comprising:

(a) a lower disk having passageway means for the beverage to pass from a position beneath the lower disk to a position above the lower disk, said lower disk having a continuous outer rim which engages the inner wall of the container to prevent the beverage from flowing between the outer rim of the lower disk and the inner wall of the container;

(b) an upper disk having a continuous outer rim, said upper disk being disposed above and spaced apart from said lower disk, the diameter of said upper disk being less than the diameter of the inner wall of the container and the entire outer rim of the upper disk being spaced apart from the inner wall of the container so that the beverage flows between the outer rim of the upper disc and the inner wall of the container at any point around the upper disc when the container is placed in an angled position; and (c) at least one baffle disposed between the lower disk and the upper disk for baffling the beverage when the container is in motion and for supporting the upper disk over the lower disk.

22. The guard of claim 21 wherein the passageway means includes one or more openings through the lower disk.

23. The guard of claim 21 which further includes a flap attached to the outer rim of the lower disk which securely engages the inner wall of the container.

24. The guard of claim 21 which further comprises a plurality of baffles extending outwardly from the center of the guard.

25. The guard of claim 24 wherein said plurality of baffles have equal spacing between each of said baffles.

26. The guard of claim 25 wherein said passageway means includes a plurality of openings through the lower disk which are evenly spaced around the lower disk, each of said opening being positioned to open into one of the equal spaces between each of the baffles.

27. The guard of claim 21 which further includes a handle attached to and extending upwardly from the upper disk.

28. The guard of claim 27 which further includes a receptacle which opens downwardly from the lower disk for removably receiving the handle of another guard when multiple guards are stacked together.

29. In combination, a drinking container and a guard for preventing splashing or sloshing of a beverage from the drinking container, said guard comprising:

(a) a lower disk having a continuous outer rim, said lower disk having passageway means for the beverage to pass from beneath the lower disk to a position above the lower disk;

(b) an upper disk having a continuous outer rim, said upper disk having a diameter which allows the beverage to flow freely at any point around the outer rim of the upper disk, said upper disk being disposed above and spaced apart from said lower disk; and (c) baffle means interposed between said lower disk and said upper disk for baffling the beverage when the drinking container is in motion and for supporting said upper disk over said lower disk; and (d) sealing means integrally attached to the outer rim of the lower disk for sealably engaging the upper edge of the drinking container.

* * * * *

UNITED STATES PATENT AND TRADEMARK OFFICE

CERTIFICATE OF CORRECTION

PATENT NO. : 5,540,350
DATED : July 30, 1996
INVENTOR(S) : Daryl J. Lansky

It is certified that error appears in the above-indentified patent and that said Letters Patent is hereby corrected as shown below:

On page 1, column 1, item [73], after Assignee:

please delete "Mallory Industries Inc., Blenheim, Canada".

On page 1, column 2, after Attorney, Agent, or Firm:

please delete "Fish & Richardson, P.C."
and insert --Baker, Donelson, Bearman & Caldwell--.

Signed and Sealed this
Twenty-eighth Day of January, 1997

*Attest:*

Bruce Lehman

BRUCE LEHMAN

*Attesting Officer* *Commissioner of Patents and Trademarks*